US009878823B2

(12) United States Patent
Davis et al.

(10) Patent No.: US 9,878,823 B2
(45) Date of Patent: Jan. 30, 2018

(54) DISPLAY PACKAGE HAVING TWO MODES

(71) Applicant: The Procter & Gamble Company, Cincinnati, OH (US)

(72) Inventors: Chanda Janese Davis, Cincinnati, OH (US); Raniele Janine Jago, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/131,737

(22) Filed: Apr. 18, 2016

(65) Prior Publication Data

US 2017/0297772 A1 Oct. 19, 2017

(51) Int. Cl.
*B65D 25/54* (2006.01)
*B65D 43/14* (2006.01)

(52) U.S. Cl.
CPC ..... *B65D 25/54* (2013.01); *B65D 43/14* (2013.01)

(58) Field of Classification Search
CPC ..... B65D 5/355; B65D 5/54; B65D 17/00; B65D 25/54; B65D 43/14; B65D 81/34; B65D 81/3453
USPC ..... 206/736–741, 756, 763–765, 769, 206/771–774
See application file for complete search history.

(56) References Cited

U.S. PATENT DOCUMENTS 6,135,289 A * 10/2000 Miller ..... B65D 5/5088 206/774
7,066,321 B2 * 6/2006 Kawaguchi ..... B65D 5/0227 206/499
8,727,204 B2 * 5/2014 Burke ..... B65D 5/2028 229/101

* cited by examiner

*Primary Examiner* — Bryon Gehman
(74) *Attorney, Agent, or Firm* — Betty J. Zea

(57) ABSTRACT

A display package for a consumer product includes a base, a surround window positioned upon the base, and a top cover positioned upon the surround window. Each of the front, back, and two opposed side walls include a respective edge defining an upper perimeter of each of the walls and each of the front, back, and two opposed side walls include a respective edge defining a lower perimeter of each of the walls, wherein these upper and lower edges are constructed such that when the surround window is positioned upon the base and the top cover is positioned upon the surround window the front exposed surface area is greater than the back exposed surface area and wherein when the surround window is removed from between the base and top cover, the edges of the top cover are constructed to mate in a close fitting relationship with the edges of the base.

26 Claims, 6 Drawing Sheets

DISPLAY PACKAGE HAVING TWO MODES

BACKGROUND OF THE INVENTION

The consumer products industry is continually releasing a variety of new and improved consumer products such as for example, cosmetic products, to provide the consumer a variety of functional and technical benefits. Some of these consumer products are designed such that two more products are to be used as complimentary to each other such as, a regimen. As such, the effectiveness of the two or more complimentary products is contingent upon the consumer using the two more products together on a regular basis, whether that use is serial or simultaneously. In addition, there is a constant conflict between providing consumer product packaging that provides ample display presence and/or surface area on a shelf while at the same time providing a compact package for storage once a consumer has purchased such product. Accordingly, there is a continued need for improved consumer product packages designed to provide ample shelf display presence as well as compact storage capabilities. In some embodiments, there is a continued need for such consumer product packages to promote and/or assist the regimental use of such two or more consumer products.

SUMMARY OF THE INVENTION

In one embodiment, a display package for a consumer product that includes a base comprising a front wall, a back wall opposite the front wall, two opposed side walls connected between the front and back walls, a display surface disposed within the walls, and a first cavity defined by the display surface to contain a first consumer product, wherein each of the front, back, and two opposed side walls include a respective edge defining an upper perimeter of each of the walls. The display package also includes a surround window positioned upon the base and a top cover positioned upon the surround window. The top cover includes a front wall, a back wall opposite the front wall, and two opposed side walls, wherein each of the front, back, and two opposed side walls include a respective edge defining a lower perimeter of each of the walls. The upper edges of the respective front, bottom, and two opposed side wall of the base and the lower edges of the respective front, bottom, and two opposed side wall of the top cover are constructed such that when the surround window is positioned upon the base and the top cover is positioned upon the surround window, the edge of the front wall of the top cover and the edge of the front wall of the base define a front exposed surface area of the front wall of the surround window, the edge of the back wall of the top cover and the edge of the back wall of the top cover define a back exposed surface area of the back wall of the surround window, and the front exposed surface area is greater than the back exposed surface area. Also, the upper edges of the respective front, bottom, and two opposed side wall of the base and the lower edges of the respective front, bottom, and two opposed side wall of the top cover are constructed such that when the surround window is removed from between the base and top cover, the edges of the top cover are constructed to mate in a close fitting relationship with the edges of the base.

In another embodiment, a display package for a consumer product includes a base comprising a front wall, a back wall opposite the front wall, two opposed side walls connected between the front and back walls, a display surface disposed within the walls, and a first cavity defined by the display surface, wherein each of the front, back, and two opposed side walls include a respective edge defining an upper perimeter of each of the walls. The package also includes a surround window positioned upon the base and comprising a front wall and a back wall. The package further includes a top cover positioned upon the surround window, the top cover comprising a front wall, a back wall opposite the front wall, and two opposed side walls, wherein each of the front, back, and two opposed side walls include a respective edge defining a lower perimeter of each of the walls. The upper edges of the respective front, bottom, and two opposed side wall of the base and the lower edges of the respective front, bottom, and two opposed side wall of the top cover are constructed such that when the surround window is positioned upon the base and the top cover is positioned upon the surround window, the edge of the front wall of the top cover and the edge of the front wall of the base define a front exposed surface area of the front wall of the surround window, the edge of the back wall of the top cover and the edge of the back wall of the top cover define a back exposed surface area of the back wall of the surround window, and the front exposed surface area is greater than the back exposed surface area. The upper edges of the respective front, bottom, and two opposed side wall of the base and the lower edges of the respective front, bottom, and two opposed side wall of the top cover are constructed such that when the surround window is removed from between the base and top cover, the top cover may be positioned upon the base such that the lower edge of the front wall of the top cover is adjacent to the upper edge of the back wall of the base and the lower edge of the back wall of the top cover is adjacent to the upper edge of the front wall of the base.

In yet another embodiment, a display package kit for a consumer product includes a base having a front wall, a back wall opposite the front wall, two opposed side walls connected between the front and back walls, a display surface disposed within the walls, and a first cavity defined by the display surface, wherein each of the front, back, and two opposed side walls include a respective edge defining an upper perimeter of each of the walls. The kit also includes a surround window having a front wall and a back wall. The kit further includes a top cover comprising a front wall, a back wall opposite the front wall, and two opposed side walls, wherein each of the front, back, and two opposed side walls include a respective edge defining a lower perimeter of each of the walls. When the package is constructed to form a display mode, the surround window is positioned upon the base and the top cover is positioned upon the surround window opposite the base such that the edge of the front wall of the top cover and the edge of the front wall of the base define a front exposed surface area of the front wall of the surround window, and the edge of the back wall of the top cover and the edge of the back wall of the base define a back exposed surface area of the back wall of the surround window, wherein the front exposed surface area is greater than the back exposed surface area. Also, when the package is constructed to form a collapsed mode, the surround window is removed from the base and the top cover is positioned directly upon the base such that the lower edge of the front wall of the top cover is adjacent to the upper edge of the back wall of the base and the lower edge of the back wall of the top cover is adjacent to the upper edge of the front wall of the base.

DETAILED DESCRIPTION OF THE INVENTION

Figure 1:
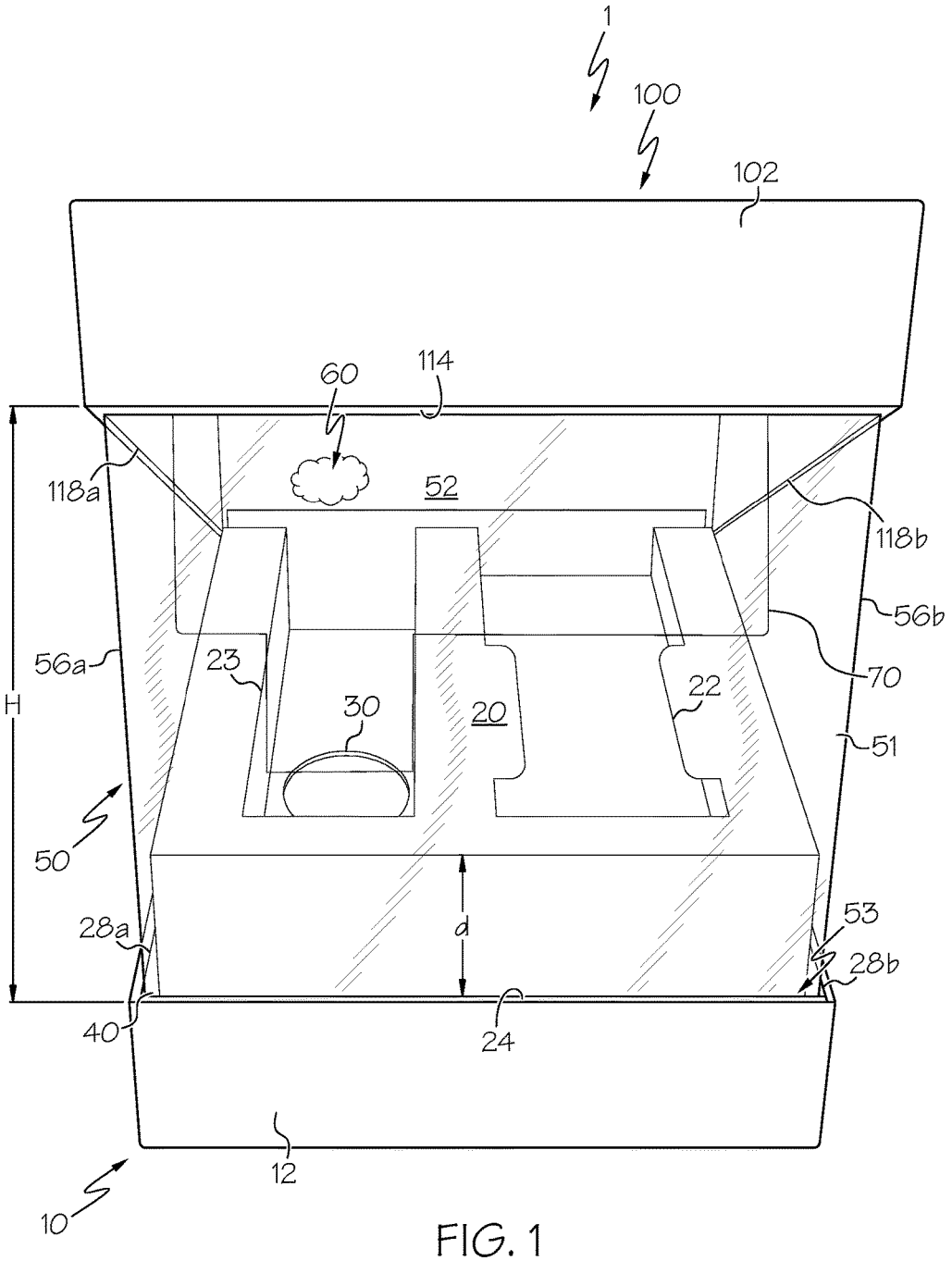
FIG. 1 is a front view of a display package in a display mode according to one or more embodiments.
Figure 2:
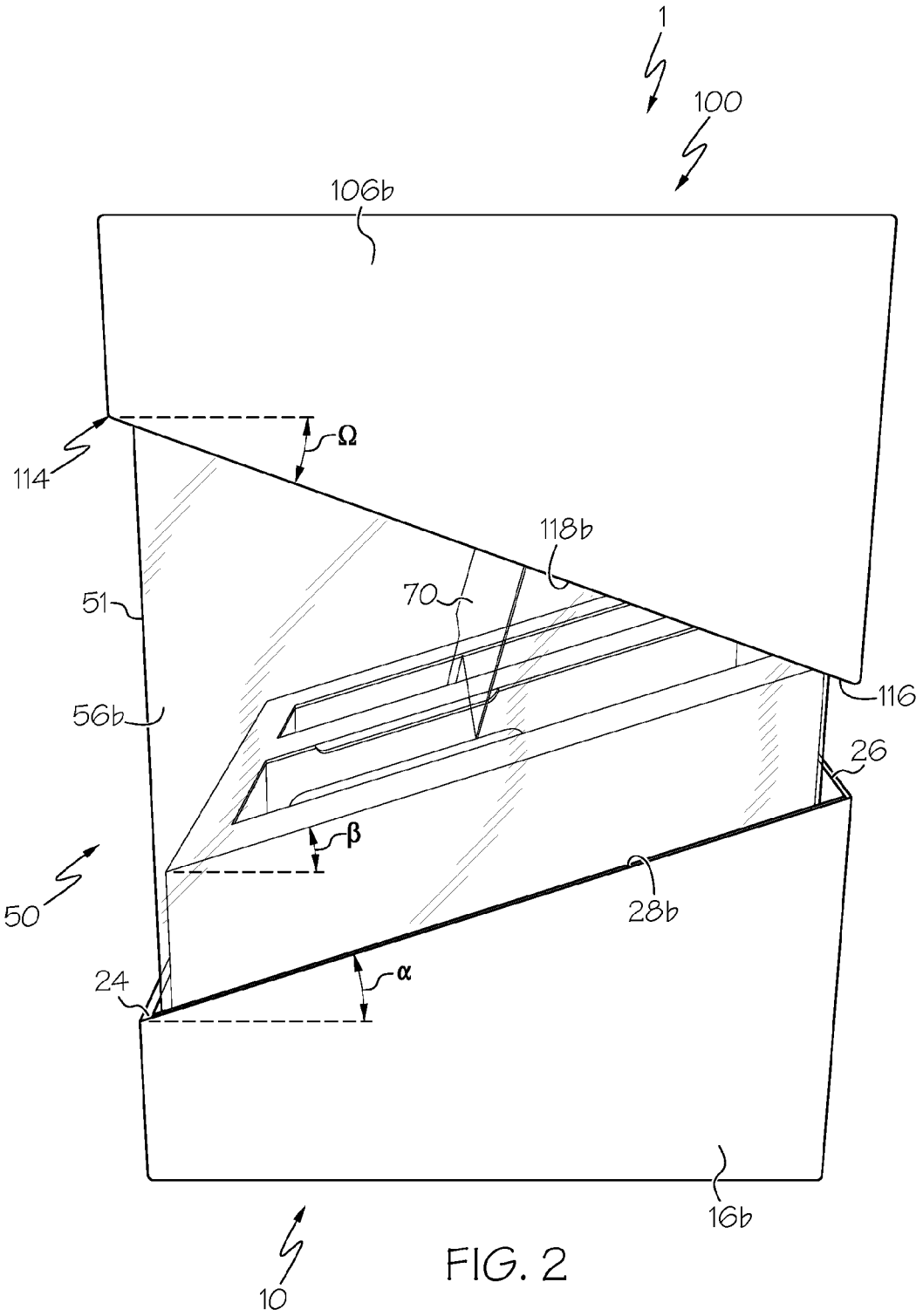
FIG. 2 is a side elevational view of the display package of FIG. 1.

The following text sets forth a broad description of numerous different embodiments. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Referring to FIGS. 1-6, a display package 1 includes a base 10, a surround window 50 removably positioned upon the base 10, and a top cover 100 removably positioned upon the surround window 50, opposite the base 10. In some embodiments, the base 10 and top cover 100 are fabricated or constructed from a wood pulp, compressed fiber board. For example, in some embodiments, the fiber board is selected from the group consisting of coated unbleached Kraft paperboard (CUK), clay natural Kraft paperboard, solid unbleached sulfate paperboard, bleached paperboard, solid bleached sulfate (SBS) paperboard, and combinations thereof. In some embodiments, the base 10 and/or top cover 100 are fabricated or constructed from one or more of the materials set forth above, and the surround window 50 is fabricated or constructed from paper, plastics, polymers, composites, or combinations thereof, including but not limited to clear plastics such as, for example, recycled polyethylene terephthalate (RPET), polyethylene terephthalate (PET or PETE), polyvinyl chloride (PVC), polyvinyl acetate, polypropylene (PP), high density polyethylene (HDPE), and polystyrene (PS), acetate, cellulose acetate and combinations thereof. In some embodiments, the base 10, surround window 50, and top cover 100 may all be constructed from clear plastics including, but not limited to, recycled polyethylene terephthalate (RPET), polyethylene terephthalate (PET or PETE), polyvinyl chloride (PVC), polyvinyl acetate, polypropylene (PP), high density polyethylene (HDPE), and polystyrene (PS), acetate, cellulose acetate and combinations thereof. In some embodiments, the base 10, surround window 50, and/or top cover 100 may be constructed as transparent acetate, PVC boxes, RPET boxes, RPET cartons, acetate boxes or any combinations thereof.

In some embodiments, the package 1 such as, for example, the base 10, surround window 50, and/or top cover 100 are fabricated or constructed from plastic(s) using an injection molding or thermoform molding process.

The base 10 includes a front wall 12, a back wall 14 opposite the front wall 12, two opposed side walls 16*a*, 16*b* connected between the front and back walls, a display surface 20 disposed within the front, back, and two opposed side walls 12, 14, and 16*a*, 16*b*. The base may also comprise a first cavity 22 defined by and/or disposed within the display surface 20. The first cavity 22 is constructed to contain a first consumer product. The front wall 12 includes an upper edge 24 that defines an upper perimeter of the front wall. The back wall 14 includes an upper edge 26 that defines an upper perimeter of the back wall. Similarly, the two opposed side walls 16*a*, 16*b* include respected upper edges 28*a*, 28*b* that define respective upper perimeters of the two opposed side walls. In some embodiments, the base 10 includes a channel 40 disposed just inside and adjacent to the upper edges 24, 26, and 28*a*, 28*b* of the front, back, and two opposed side walls, respectively.

As shown, the two upper edges 28*a*, 28*b* of the respective two opposed side walls 16*a*, 16*b* angle upward (i.e., a positive slope) at an angle $\alpha$ (relative to an imaginary horizontal reference plane) from the upper edge 24 of the front wall 12 to the upper edge 26 of the back wall 14. As such, the back wall 14 has a height that is greater than a height of the front wall 12. Alternatively, the two upper edges 28*a*, 28*b* of the respective two opposed side walls 16*a*, 16*b* angle downward (i.e., a negative slope) at an angle (relative to an imaginary horizontal reference plane) from the upper edge 26 of the back wall 14 to the upper edge 24 of the front wall 12.

The display surface 20 may extend at an upward angle $\beta$ (relative to an imaginary horizontal plane) away from a point adjacent to the upper edge 24 of the front wall 12 to a point adjacent the upper edge 26 of the back wall 14. Alternatively, the display surface 20 angles downward (relative to an imaginary horizontal reference plane) from a point adjacent the upper edge 26 to a point adjacent the upper edge 24. As shown, in this embodiment, the angle $\alpha$ is equal or substantially similar to angle $\beta$. In some embodiments, these two angles are different from each other.

The display surface 20 does not have to be directly connected to the front wall and/or the back wall in this embodiment. For example, the display surface 20 may be raised a distance (d) above the upper edges 24, 26, and 28*a*, 28*b* of the front, back, and two opposed side walls, respectively. As shown, the display surface 20 is elevated a distance (d) from the upper edges 24, 26, and 28*a*, 28*b* of the front, back, and two opposed side walls, respectively. In some embodiments, distance (d) is from 0.1 cm to about 100 cm, from 0.5 cm to about 50 cm, from about 1 cm to about 25 cm, from about 1 cm to about 5 cm. In some embodiments, the display surface may be flushed with the upper edges 24, 26, and 28*a*, 28*b*. As such, distance (d) equals 0 cm.

The display surface 20 and/or the first cavity 22 may be constructed to receive a first consumer product. In addition, the display surface 20 may define a second cavity 23 positioned adjacent to the first cavity 22. The second cavity 23 may be constructed to contain and/or hold a second consumer product. The first and second cavities 22 and 23, respectively, may include respective bottom walls 32, 34 that are angled at the same angle as angle β. It is understood that the bottom walls 32, 34 could be oriented at a horizontal orientation or an angle different from angle β.

The second cavity 23 may include a third cavity 30 disposed within the bottom wall 32. The third cavity 30 is constructed to hold the second consumer product in an upright orientation such that the second consumer product may extend upward above the display surface 20 and the upper edges 24 and 26. The second cavity is constructed such that the second consumer product may be oriented within the second cavity in either of two orientations: a substantially vertical orientation wherein the second consumer product is disposed within the third cavity or an orientation different from the vertical orientation such that the second consumer product is not disposed within the third cavity.

The surround window 50 may comprise a front wall 51, a back wall 54 opposite the front wall, and two opposed side walls 56*a*, 56*b*. The surround window 50 may be constructed from a material such as those set forth above that is translucent, transparent, or opaque. In this embodiment, the surround window 50 is translucent. The front, back, and two opposed side walls 51, 54, and 56*a*, 56*b*, respectively, the base 10 and the top cover 100 form a space 60 therein. In some embodiments, the surround window 50 may be positioned upon the base 10 such that a lower end 53 of the surround window slides into and/or is received within the channel 40 of the base 10.

An intermediate wall 70 may be disposed between the front, back, and two opposed side walls 51, 54, and 56*a*, 56*b*, respectively. The intermediate wall 70 may be integral to the surround window 50 or a separate component that is either attached or not attached to the window 50. In some embodiments, the intermediate wall 70 extends downwardly from an upper wall (not shown) or an upper edge (not shown) of the back wall 54 of the window 50. In some embodiments, the intermediate wall 70 may pivot relative to the window 50. In some embodiments, the intermediate wall 70 is constructed from a material that is translucent, transparent, or opaque.

In some embodiments, the intermediate wall 70 may include package graphics on one or more of its front and back surfaces such that such package graphics may be viewable through any one or more of the front wall 51, back wall 54, or two opposed side walls 56*a*, 56*b*. The package graphics may include, but not be limited to, advertising, branding, trademarks, logos, artwork, photographs, product information, instructions of use, advertising claims, product comparison data and the like.

In some embodiments, an extension may extend downwardly from the surface 70. The extension may have the same width or a narrower width than the surface 70. The extension may extend some distance from a distal end of the surface 70 and then bend or angle toward the back wall 54 or front wall 51 at any angle between 0 degrees and 180 degrees. In some embodiments, the extension extends a distance from a distal end of the intermediate wall 70 and then angle back toward the back wall 54 such that the extension rests upon the bottom wall of second cavity 23. In some embodiments, the intermediate wall 70 may provide a support or back stop for the second consumer product held within the third cavity 30. In some embodiments, the intermediate wall 70 may even prevent the second consumer product from falling from its upright position within the third cavity 70. In some embodiments, the extension may only travel along the bottom wall of the second cavity 23 a distance until the extension contacts the back wall 14 of the base 10. Thus, the extension's length can be manipulated or constructed to maximize or minimize the travel of the extension along the bottom wall of second cavity 23 and thus maximize or minimize the travel of the intermediate wall 70 relative to the front wall 51.

In some embodiments, the extension may insert into a slit, aperture, or cavity constructed to receive such extension and hold or fix the surface 70 in a set angular position relative to the front wall 51. In one example, the extension is disposed and received within the third cavity 30 to hold and/or fix the display surface 70 in a set angular position relative to the front wall 51. Other convention mechanisms and/or methods constructed to detachably hold the display surface 70 in a set angular position relative to the front wall 51 may also be used in other embodiments.

The top cover 100 includes a front wall 102, a back wall 104 opposite the front wall, and two opposed side walls 106*a*, 106*b* connected between the front and back walls. The front wall 102 includes a lower edge 114 that defines a lower perimeter of the front wall. The back wall 104 includes a lower edge 116 that defines a lower perimeter of the back wall. Similarly, the two opposed side walls 106*a*, 106*b* include respected lower edges 118*a*, 118*b* that define respective lower perimeters of the two opposed side walls. In some embodiments, the top cover 100 includes a channel (not shown) disposed just inside and adjacent to the lower edges 114, 116, and 118*a*, 118*b* of the front, back, and two opposed side walls, respectively. The channel may be similar to or the same as the channel 40 of the base 10.

As shown, the two lower edges 118*a*, 118*b* of the respective two opposed side walls 106*a*, 106*b* angle downward (i.e., a negative slope) at an angle Ω (relative to an imaginary horizontal reference plane) from the lower edge 24 of the front wall 102 to the lower edge 116 of the back wall 104. As such, the back wall 104 has a height that is greater than a height of the front wall 102. Alternatively, the two lower edges 118*a*, 118*b* of the respective two opposed side walls 106*a*, 106*b* angle upward (i.e., a positive slope) at an angle (relative to an imaginary horizontal reference plane) from the lower edge 116 of the back wall 104 to the lower edge 114 of the front wall 102. In some embodiments, the angle Ω is from about 0.5 degrees to about 75 degrees. In some embodiments, the angle Ω comprise from about 16 degrees to about 30 degrees. In some embodiments, angle Ω is the same as or substantially the same as angle α. In other embodiments, the angle Ω is different than the angle α.

Figure 3:
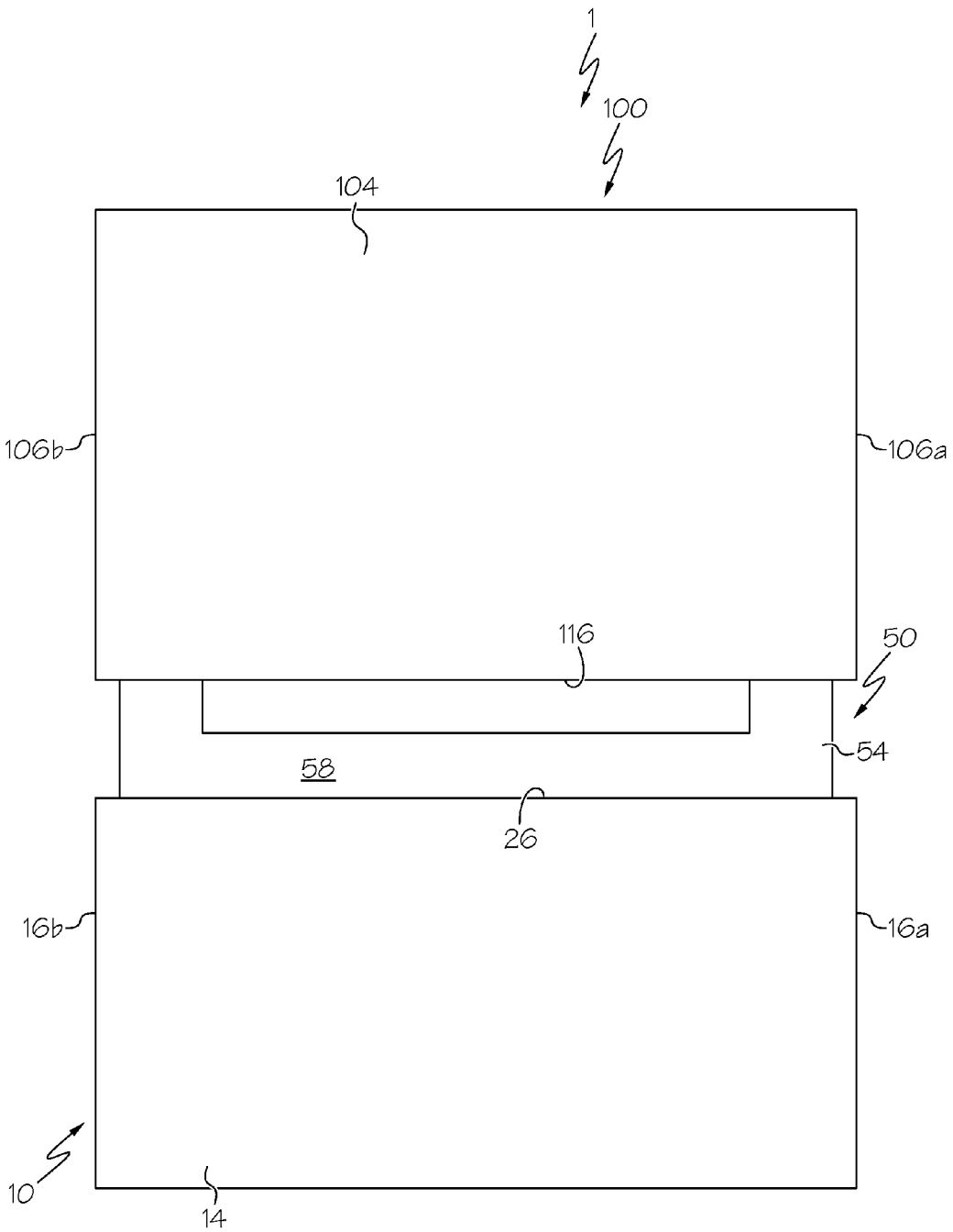
FIG. 3 is a back view of the display package of FIG. 1.

When the surround window 50 is positioned between the top cover 100 and base 10, the upper edge 24 of the front wall 12 and the lower edge 114 of the front wall 102 define a front exposed surface area 52 of the front wall 51 disposed between those two edges as shown in FIG. 1, and the upper edge 26 of the back wall 14 and the lower edge 116 of the back wall 104 define a back exposed surface area 58 of the back wall 54 disposed between those two edges as shown in FIG. 3. As shown, in some embodiments, the front exposed surface area of the window 50 is greater than the back exposed surface area 58 of the window, when the package 1 is in the display mode (e.g., FIGS. 1-3), i.e., when the surround window 50 is positioned upon the base 10 and the top cover 100 is positioned upon the surround window 50. In some embodiments, the ratio of the front exposed surface area to the back exposed surface area is from about 1.5:1 to about 7:1. In some embodiments, the ratio of the front exposed surface area to the back exposed surface area is from about 3:1 to about 5:1. In some embodiments, the front exposed surface area has a height (H) of about 5 cm to about 20 cm. In some embodiments, the height (H) of the front exposed surface area is from about 7 cm to about 12 cm.

Figure 4:
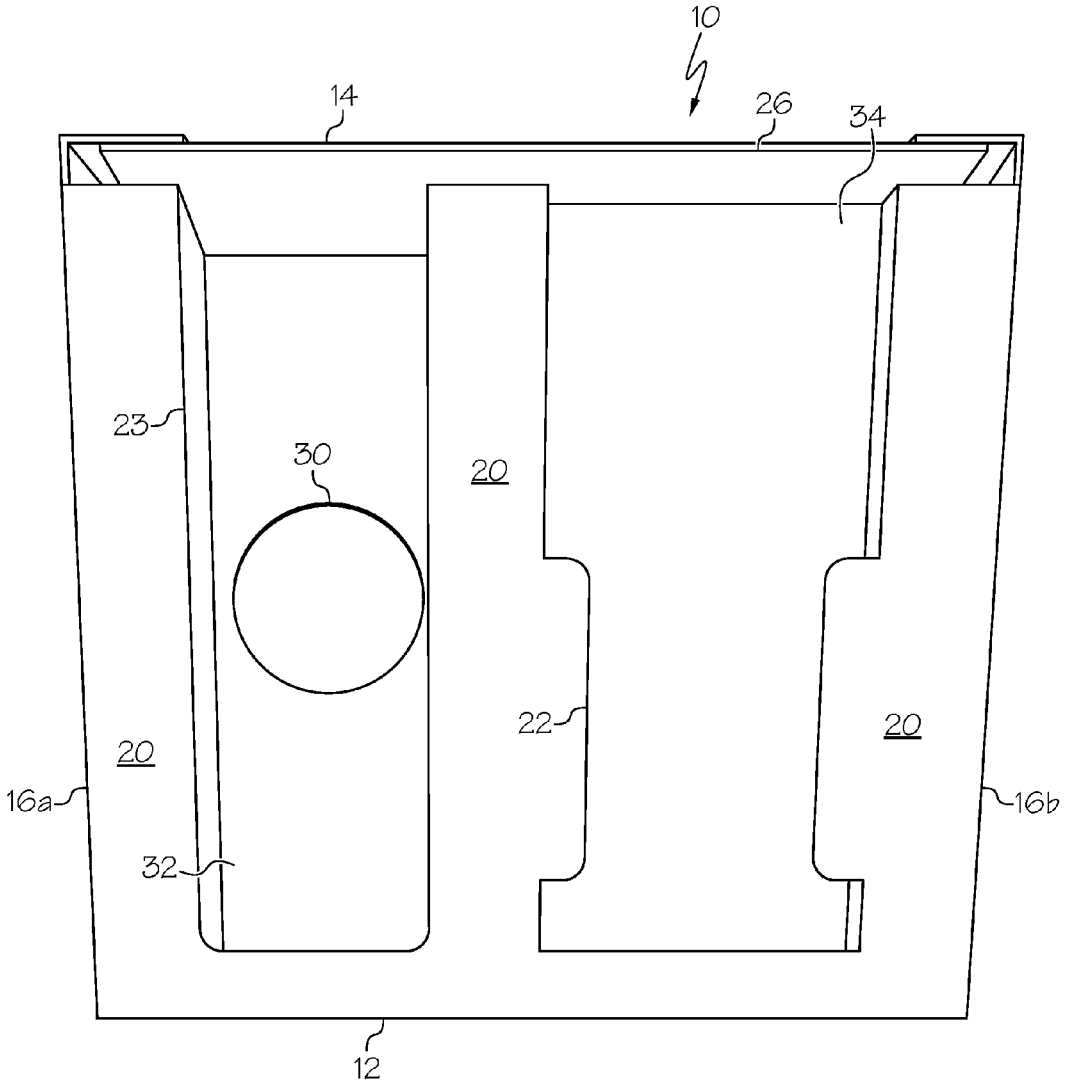
FIG. 4 is a top plan view of a base of the display package of FIG. 1 with a surround window and a top cover removed.

FIG. 4 is a top plan view of the base 10 with the top cover 100 and surround window 50 removed.

Figure 5:
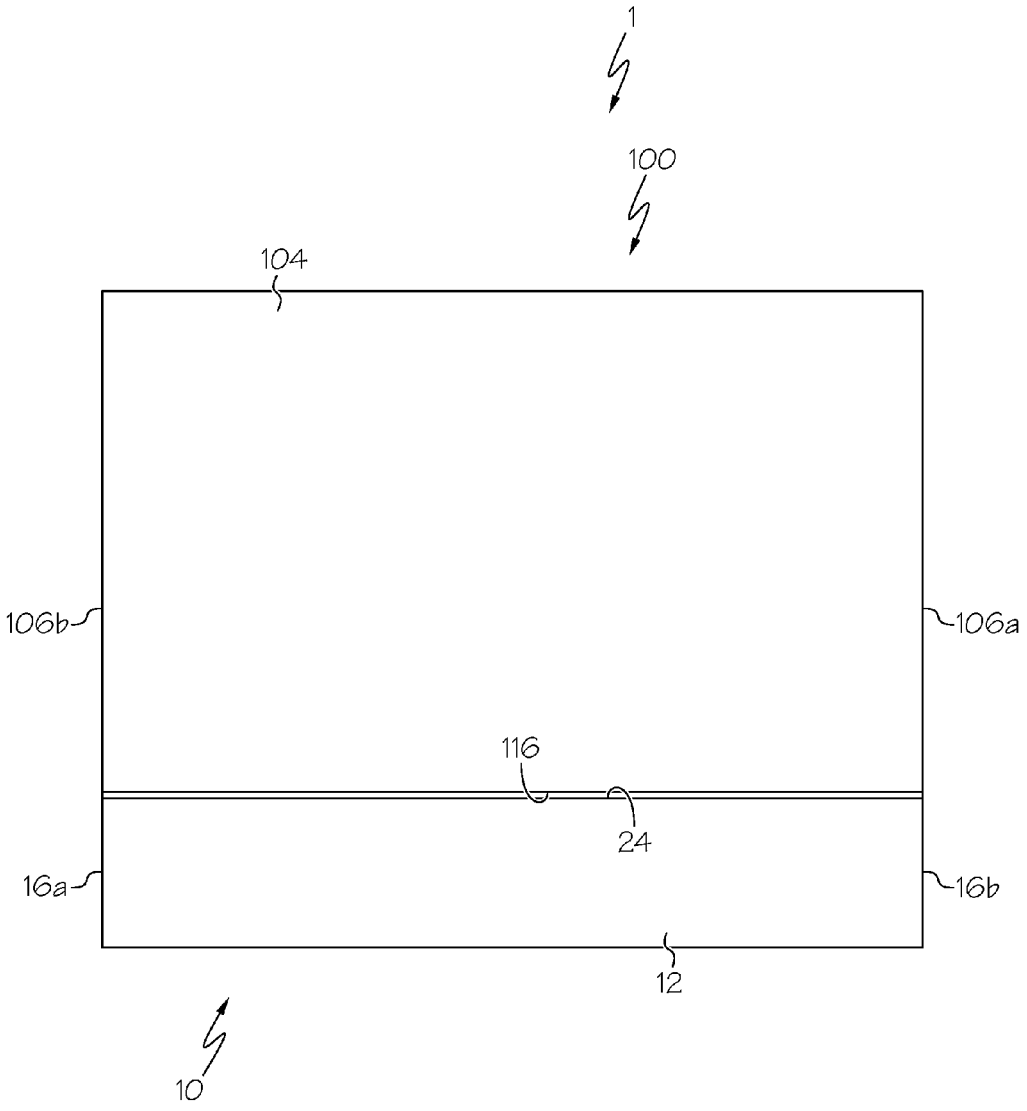
FIG. 5 is a front view of the display package of FIG. 1 in a collapsed mode.
Figure 6:
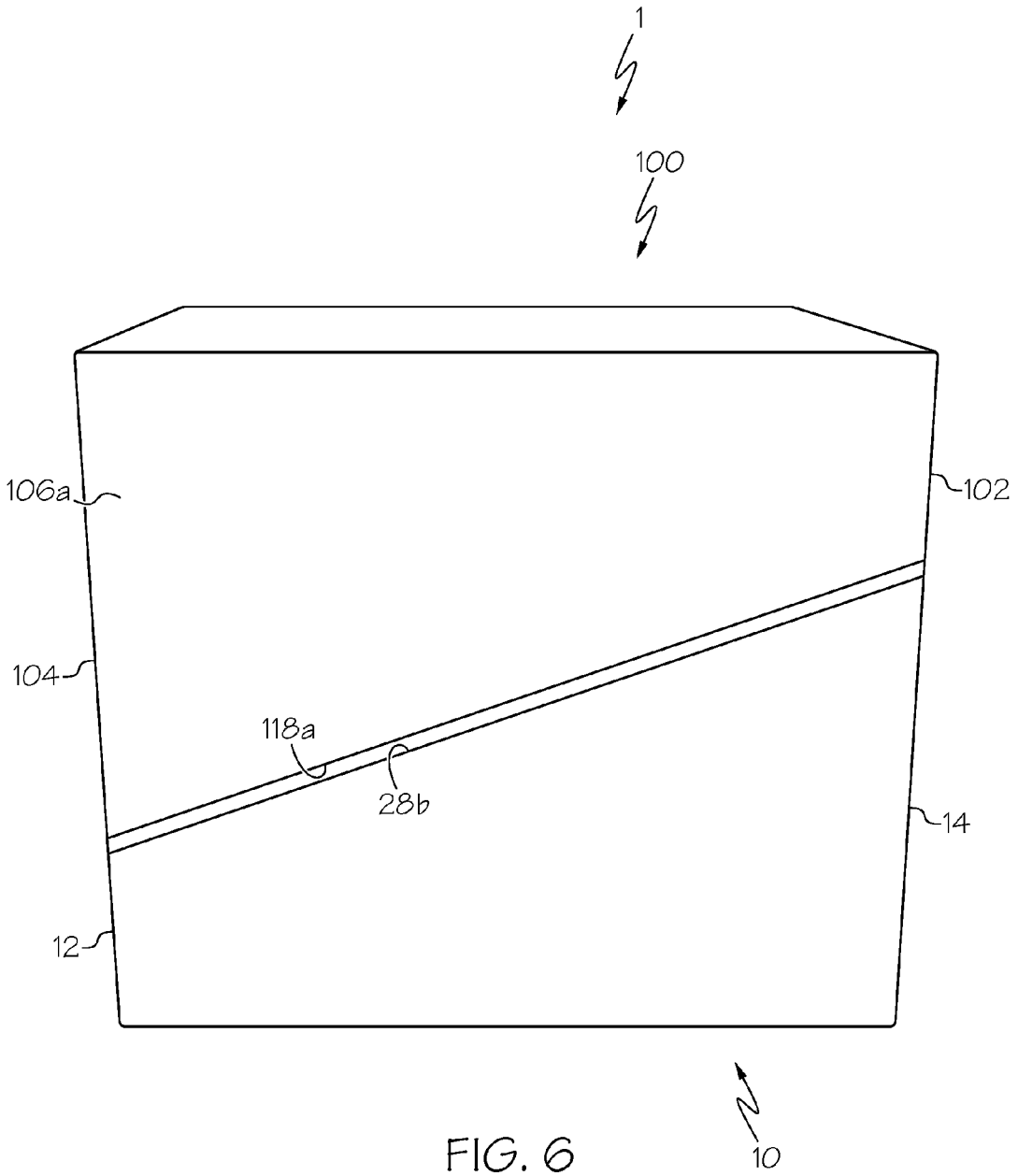
FIG. 6 is a side elevational view of the display package of FIG. 5.

Referring to FIGS. 5-6, the package 1 is reconfigured or constructed to form a collapsed mode or storage mode. Specifically, the surround window 50 is removed from the base 10. With the surround window removed, the top cover 100 may be rotated 180 degrees such that the lower edge 116 of the back wall 104 of the top cover 100 is adjacent to the upper edge 24 of the front wall 12 of the base 10 and the lower edge 114 of the front wall 102 is adjacent to the upper edge 26 of the back wall 14 of the base 10. In some embodiments, when the surround window 50 is removed from the base 10 and the top cover 100 is positioned directly upon the base 10, the upper edges 24, 26, and 28*a*, 28*b*, respectively, of the base 10 are in close fitting relationship with the lower edges 114, 116, and 118*a*, 118*b*, respectively, of the top cover 100. In some embodiments, the upper edge 24 of the base is adjacent to the lower edge 116 of the top cover, the upper edge 26 of the base is adjacent to the lower edge 114 of the top cover, the upper edge 28*a* of the base is adjacent to the lower edge 118*b* of the top cover, and the upper edge 28*b* of the base is adjacent to the lower edge 118*a* of the top cover.

In some embodiments, a connector (not shown) may be included on one or more of the walls and/or edges of the base 10 and/or top cover 100 to further enhance a close fitting relationship between the respective edges of the base and top cover as set forth above herein. Illustrative examples of such connectors may include protrusion and corresponding detents positioned upon respective base and top cover walls and/or edges to provide a snap-fit connection between the base and top cover. In some embodiments, the connectors may include a protrusions and corresponding apertures positioned upon respective base and top cover walls and/or edges to provide snap-fit connection between the base and top cover. The protrusions may have a portion of its body that has a flexible width or diameter that is larger than the width or diameter of the aperture when this portion is in its natural state, but then flex sufficiently enough to permit the protrusion to slide through the aperture and then this portion flexes back to its natural state, providing a snap-fit connection or joint between the base 10 and top cover 100.

In some embodiments, the first consumer product and second consumer product are complimentary to each other. In some embodiments, the first and second products are adapted, constructed, or designed to be used as a regimen. In some embodiments, the first and second consumer products are selected from the group consisting of one or more non-substrate compositions, one or more substrates, and combinations thereof. In some embodiments, the one or more substrates include(s) a plurality of patches. In some embodiments, these patches are provided in sheet single use form.

A) A display package for a consumer product, the package comprising:

a base comprising a front wall, a back wall opposite the front wall, two opposed side walls connected between the front and back walls, a display surface disposed within the walls, and a first cavity defined by the display surface to contain a first consumer product, wherein each of the front, back, and two opposed side walls include a respective edge defining an upper perimeter of each of the walls;

a surround window positioned upon the base;

a top cover positioned upon the surround window, the top cover comprising a front wall, a back wall opposite the front wall, and two opposed side walls, wherein each of the front, back, and two opposed side walls include a respective edge defining a lower perimeter of each of the walls;

wherein the upper edges of the respective front, bottom, and two opposed side wall of the base and the lower edges of the respective front, bottom, and two opposed side wall of the top cover are constructed such that:

when the surround window is positioned upon the base and the top cover is positioned upon the surround window:

the edge of the front wall of the top cover and the edge of the front wall of the base define a front exposed surface area of the front wall of the surround window, the edge of the back wall of the top cover and the edge of the back wall of the top cover define a back exposed surface area of the back wall of the surround window, the front exposed surface area is greater than the back exposed surface area, and wherein when the surround window is removed from between the base and top cover, the edges of the top cover are constructed to mate in a close fitting relationship with the edges of the base.

B) A display package for a consumer product, the package comprising:

a base comprising a front wall, a back wall opposite the front wall, two opposed side walls connected between the front and back walls, a display surface disposed within the walls, and a first cavity defined by the display surface, wherein each of the front, back, and two opposed side walls include a respective edge defining an upper perimeter of each of the walls;

a surround window positioned upon the base and comprising a front wall and a back wall;

a top cover positioned upon the surround window, the top cover comprising a front wall, a back wall opposite the front wall, and two opposed side walls, wherein each of the front, back, and two opposed side walls include a respective edge defining a lower perimeter of each of the walls;

wherein the upper edges of the respective front, bottom, and two opposed side wall of the base and the lower edges of the respective front, bottom, and two opposed side wall of the top cover are constructed such that:

when the surround window is positioned upon the base and the top cover is positioned upon the surround window:

the edge of the front wall of the top cover and the edge of the front wall of the base define a front exposed surface area of the front wall of the surround window, the edge of the back wall of the top cover and the edge of the back wall of the top cover define a back exposed surface area of the back wall of the surround window, the front exposed surface area is greater than the back exposed surface area, and wherein when the surround window is removed from between the base and top cover, the top cover may be positioned upon the base such that the lower edge of the front wall of the top cover is adjacent to the upper edge of the back wall of the base and the lower edge of the back wall of the top cover is adjacent to the upper edge of the front wall of the base.

C) A display package kit for a consumer product, the package kit comprising:

a base comprising a front wall, a back wall opposite the front wall, two opposed side walls connected between the front and back walls, a display surface disposed within the walls, and a first cavity defined by the display surface, wherein each of the front, back, and two opposed side walls include a respective edge defining an upper perimeter of each of the walls;

a surround window comprising a front wall and a back wall;

a top cover comprising a front wall, a back wall opposite the front wall, and two opposed side walls, wherein each of the front, back, and two opposed side walls include a respective edge defining a lower perimeter of each of the walls;

wherein when the package is constructed to form a display mode, the surround window is positioned upon the base and the top cover is positioned upon the surround window opposite the base such that the edge of the front wall of the top cover and the edge of the front wall of the base define a front exposed surface area of the front wall of the surround window, and the edge of the back wall of the top cover and the edge of the back wall of the base define a back exposed surface area of the back wall of the surround window, wherein the front exposed surface area is greater than the back exposed surface area;

wherein when the package is constructed to form a collapsed mode, the surround window is removed from the base and the top cover is positioned directly upon the base such that the lower edge of the front wall of the top cover is adjacent to the upper edge of the back wall of the base and the lower edge of the back wall of the top cover is adjacent to the upper edge of the front wall of the base.

D) The package of any one of paragraphs A-C, wherein the ratio of the front exposed surface area to the back exposed surface area is from about 1.5:1 to about 7:1.

E) The package of paragraph D, wherein the ratio of the front exposed surface area to the back exposed surface area is from about 3:1 to about 5:1.

F) The package of any one of paragraphs A-C, wherein front exposed surface area has a height of about 5 cm to about 20 cm.

G) The package of paragraph F, wherein the height of the front exposed surface area is from about 7 cm to about 12 cm.

H) The package of any one of paragraphs A-C, wherein the upper edges of the respective two opposed side walls of the base each traverses from a point adjacent to the front wall to a point adjacent to the back wall at respective upward angles $\alpha$.

I) The package of paragraph H, wherein the angles $\alpha$ comprise from about 0.5 degrees to about 75 degrees.

J) The package of paragraph I, wherein the angles $\alpha$ comprise from about 16 degrees to about 30 degrees.

K) The package of paragraph H, wherein the lower edges of the respective two opposed side walls of the base each traverses from the front wall to the back wall at respective angles $\Omega$.

L) The package of paragraph K, wherein the angles $\Omega$ comprise from about 0.5 degrees to about 75 degrees.

M) The package of paragraph L, wherein the angles $\Omega$ comprise from about 16 degrees to about 30 degrees.

N) The package of paragraph K, wherein the display surface is disposed at a downward angle $\beta$ from the front wall to the back wall.

O) The package of paragraph N, wherein the surround window is transparent.

P) The package of paragraph N, wherein the surround window further comprises an intermediate surface positioned between the front and back walls of the surround window.

Q) The package of paragraph P, wherein the intermediate surface comprises package graphics viewable through the front exposed surface area of the surround window.

R) The package of any one of paragraphs A-C, wherein the base comprises a channel disposed inside the upper edges of the front, back, and two opposed side walls and the surround window comprises a lower end, and wherein the lower end of the surround window is received within the channel.

S) The package of any one of paragraphs A-C, wherein when the surround window is removed from between the base and top cover, the top cover may be positioned upon the base such that the lower edge of the front wall of the top cover is adjacent to the upper edge of the back wall of the base and the lower edge of the back wall of the top cover is adjacent to the upper edge of the front wall of the base.

T) The package of any one of paragraphs A-C, further comprising a second cavity disposed within the front, back, and two opposed side walls and adjacent to the first cavity of the base, the second cavity constructed to contain a second consumer product.

U) The package of paragraph T, wherein the second cavity comprises a third cavity disposed therein, wherein the second consumer product may be disposed within the third cavity in a substantially vertical orientation or disposed within the second cavity in an orientation different from the vertical orientation.

V) The package of paragraph T, wherein the first consumer product and second consumer product are complimentary to each other.

W) The package of paragraph V, wherein the first and second products are adapted to be used as a regimen.

X) The package of paragraph V, wherein the first and second consumer products are selected from the group consisting of one or more non-substrate compositions, one or more substrates, and combinations thereof.

Y) The package of paragraph X, wherein the one or more substrates comprises a plurality of patches provided in sheet single use form.

Z) The package of any one of paragraphs A-C, further comprising a connector that connects the top cover to the base in the close fitting relationship.

It should be understood that any feature and/or element of any one of the embodiments and/or examples shown and described above herein may be removed from the embodiment and/or example, replaced with a feature or element from another embodiment or example herein or replaced with an equivalent feature or element.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made. It is therefore intended to cover in the appended claims all such changes and modifications.

What is claimed is:

1. A display package for a consumer product, the package comprising:

a base comprising a front wall, a back wall opposite the front wall, two opposed side walls connected between the front and back walls, a display surface disposed within the walls, and a first cavity defined by the display surface to contain a first consumer product, wherein each of the front, back, and two opposed side walls includes a respective edge, the edges collectively defining an upper perimeter of the base;

a surround window positioned upon the base;

a top cover positioned upon the surround window, the top cover comprising a front wall, a back wall opposite the front wall, and two opposed side walls, wherein each of the front, back, and two opposed side walls includes a respective edge, the edges collectively defining a lower perimeter of the top cover;

wherein the upper edges of the respective front, back, and two opposed side walls of the base and the lower edges of the respective front, back, and two opposed side walls of the top cover are constructed such that:

when the surround window is positioned upon the base and the top cover is positioned upon the surround window:

the edge of the front wall of the top cover and the edge of the front wall of the base define a front exposed surface area of the front wall of the surround window, the edge of the back wall of the top cover and the edge of the back wall of the base define a back exposed surface area of the back wall of the surround window, the front exposed surface area is greater than the back exposed surface area, and wherein when the surround window is removed from between the base and top cover, the edges of the top cover are constructed to mate in a close fitting relationship with the edges of the base.

2. The package of claim 1, wherein the ratio of the front exposed surface area to the back exposed surface area is from about 1.5:1 to about 7:1.

3. The package of claim 2, wherein the ratio of the front exposed surface area to the back exposed surface area is from about 3:1 to about 5:1.

4. The package of claim 1, wherein the front exposed surface area has a height of about 5 cm to about 20 cm.

5. The package of claim 4, wherein the height of the front exposed surface area is from about 7 cm to about 12 cm.

6. The package of claim 1, wherein the upper edges of the respective two opposed side walls of the base each traverse from a point adjacent to the front wall to a point adjacent to the back wall at respective upward angles $\alpha$.

7. The package of claim 6, wherein the angles $\alpha$ comprise from about 0.5 degrees to about 75 degrees.

8. The package of claim 7, wherein the angles $\alpha$ comprise from about 16 degrees to about 30 degrees.

9. The package of claim 6, wherein the lower edges of the respective two opposed side walls of the base each traverse from the front wall to the back wall at respective angles $\Omega$.

10. The package of claim 9, wherein the angles $\Omega$ comprise from about 0.5 degrees to about 75 degrees.

11. The package of claim 10, wherein the angles $\Omega$ comprise from about 16 degrees to about 30 degrees.

12. The package of claim 9, wherein the display surface is disposed at a downward angle $\beta$ from the front wall to the back wall.

13. The package of claim 12, wherein the surround window is transparent.

14. The package of claim 12, wherein the surround window further comprises an intermediate wall positioned between the front and back walls of the surround window.

15. The package of claim 14, wherein the intermediate wall comprises package graphics viewable through the front exposed surface area of the surround window.

16. The package of claim 1, wherein the base comprises a channel disposed inside the upper edges of the front, back, and two opposed side walls and the surround window comprises a lower end, and wherein the lower end of the surround window is received within the channel.

17. The package of claim 1, wherein when the surround window is removed from between the base and top cover, the top cover may be positioned upon the base such that the lower edge of the front wall of the top cover is adjacent to the upper edge of the back wall of the base and the lower edge of the back wall of the top cover is adjacent to the upper edge of the front wall of the base.

18. The package of claim 1, further comprising a second cavity disposed within the front, back, and two opposed side walls and adjacent to the first cavity of the base, the second cavity constructed to contain a second consumer product.

19. The package of claim 18, wherein the second cavity comprises a third cavity disposed therein, wherein the second consumer product may be disposed within the third cavity in a substantially vertical orientation or disposed within the second cavity in an orientation different from the vertical orientation.

20. The package of claim 18, wherein the first consumer product and second consumer product are complementary to each other.

21. The package of claim 20, wherein the first and second products are adapted to be used as a regimen.

22. The package of claim 20, wherein the first and second consumer products are selected from the group consisting of one or more non-substrate compositions, one or more substrates, and combinations thereof.

23. The package of claim 22, wherein the one or more substrates comprise a plurality of patches provided in sheet single use form.

24. The package of claim 1, further comprising a connector that connects the top cover to the base in the close fitting relationship.

25. A display package for a consumer product, the package comprising:

a base comprising a front wall, a back wall opposite the front wall, two opposed side walls connected between the front and back walls, a display surface disposed within the walls, and a first cavity defined by the display surface, wherein each of the front, back, and two opposed side walls includes respective edge, the edges collectively defining an upper perimeter of the base;

a surround window positioned upon the base and comprising a front wall and a back wall;

a top cover positioned upon the surround window, the top cover comprising a front wall, a back wall opposite the front wall, and two opposed side walls, wherein each of the front, back, and two opposed side walls includes respective edge, the edges collectively defining a lower perimeter of the top cover;

wherein the upper edges of the respective front, back, and two opposed side walls of the base and the lower edges of the respective front, back, and two opposed side walls of the top cover are constructed such that:

when the surround window is positioned upon the base and the top cover is positioned upon the surround window:

the edge of the front wall of the top cover and the edge of the front wall of the base define a front exposed surface area of the front wall of the surround window, the edge of the back wall of the top cover and the edge of the back wall of the base define a back exposed surface area of the back wall of the surround window, the front exposed surface area is greater than the back exposed surface area, and wherein when the surround window is removed from between the base and top cover, the top cover may be positioned upon the base such that the lower edge of the front wall of the top cover is adjacent to the upper edge of the back wall of the base and the lower edge of the back wall of the top cover is adjacent to the upper edge of the front wall of the base.

26. A display package kit for a consumer product, the package kit comprising:

a base comprising a front wall, a back wall opposite the front wall, two opposed side walls connected between the front and back walls, a display surface disposed within the walls, and a first cavity defined by the display surface, wherein each of the front, back, and two opposed side walls includes respective edge, the edges collectively defining an upper perimeter of the base;

a surround window comprising a front wall and a back wall;

a top cover comprising a front wall, a back wall opposite the front wall, and two opposed side walls, wherein each of the front, back, and two opposed side walls includes respective edge, the edges collectively defining a lower perimeter of the top cover;

wherein when the package kit is constructed to form a display mode, the surround window is positioned upon the base and the top cover is positioned upon the surround window opposite the base such that the edge of the front wall of the top cover and the edge of the front wall of the base define a front exposed surface area of the front wall of the surround window, and the edge of the back wall of the top cover and the edge of the back wall of the base define a back exposed surface area of the back wall of the surround window, wherein the front exposed surface area is greater than the back exposed surface area;

wherein when the package kit is constructed to form a collapsed mode, the surround window is removed from the base and the top cover is positioned directly upon the base such that the lower edge of the front wall of the top cover is adjacent to the upper edge of the back wall of the base and the lower edge of the back wall of the top cover is adjacent to the upper edge of the front wall of the base.

* * * * *